US006605801B2

(12) United States Patent
Haussner et al.

(10) Patent No.: US 6,605,801 B2
(45) Date of Patent: Aug. 12, 2003

(54) ROD GLOW PLUG

(75) Inventors: Michael Haussner, Benningen (DE); Helmut Buck, Erdmannhausen (DE); Heiko Sülzle, Ludwigsburg (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 10/117,213

(22) Filed: Apr. 8, 2002

(65) Prior Publication Data

US 2002/0144990 A1 Oct. 10, 2002

(30) Foreign Application Priority Data

Apr. 9, 2001 (DE) ..... 101 17 641

(51) Int. Cl.[7] ..... F23Q 7/00
(52) U.S. Cl. ..... 219/270; 123/145 A
(58) Field of Search ..... 219/270; 123/145, 123/145 A

(56) References Cited

U.S. PATENT DOCUMENTS 4,762,101 A * 8/1988 Manolis ..... 123/145 A
5,521,356 A * 5/1996 Bauer ..... 219/270
5,645,742 A * 7/1997 Schmidt et al. ..... 219/270
6,255,626 B1 * 7/2001 Endler et al. ..... 219/270
6,278,088 B1 * 8/2001 Eller et al. ..... 219/270
6,314,930 B1 * 11/2001 Eller et al. ..... 123/145
6,335,516 B1 * 1/2002 Muller et al. ..... 219/270
6,392,199 B1 * 5/2002 Endler et al. ..... 219/270
2002/0036193 A1 * 3/2002 Heinz et al. ..... 219/270

FOREIGN PATENT DOCUMENTS

DE 3441169 * 5/1986 ..... F23Q/7/00
DE 3501307 * 7/1986 ..... F23Q/7/00
DE 199 20 766 C1 12/2000
DE 1072790 * 1/2001 ..... F02P/17/12

* cited by examiner

*Primary Examiner*—Teresa Walberg
*Assistant Examiner*—Leonid M Fastovsky
(74) *Attorney, Agent, or Firm*—Nixon Peabody LLP; David S. Safran

(57) ABSTRACT

Rod glow plug with a plug body and an internal heating rod. Between the heating rod (1) and the plug body (7) in the area of a seal seat of the rod glow plug, an electrically insulating shaped part (3) securely adjoins the heating rod (1) supporting the combustion space-side end **(7*a*) of the plug body (7), electrically insulated from the heating rod (1)**.

18 Claims, 6 Drawing Sheets

ROD GLOW PLUG

BACKGROUND OF THE INVENTION

1. Field of the Invention

The invention relates to a rod glow plug with a plug body and an internal heating rod.

2. Description of Related Art

In rod glow plugs of the generic type, the conventionally metallic plug body is electrically insulated from the internal heating rod. Depending on the construction principles, this takes place in very different ways, different advantages being achieved or disadvantages arising.

SUMMARY OF THE INVENTION

The primary object of the invention is to provide a rod glow plug which can be easily mass-produced and which can be used as a simple rod glow plug or as a measurement glow plug.

This object is achieved in accordance with the invention by the rod glow plug having an electrically insulating shaped part which securely adjoins the heating rod between the heating rod and the plug body in the area of a seal seat of the rod glow plug, the electrically insulating shaped part being supported on or in the combustion space-side end of the plug body, insulated from the heating rod The invention is explained in detail below with reference to the accompanying figures of the drawings.

DETAILED DESCRIPTION OF THE INVENTION

Figure 1:
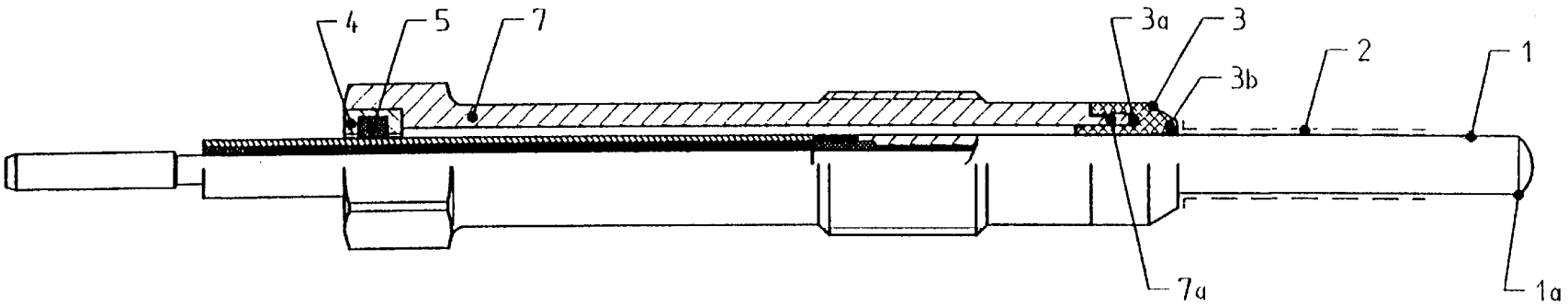
FIG. 1 is a partial lengthwise section of an embodiment of the invention in which the plug body is pressed into the shaped part.

FIG. 1 shows a preferred embodiment of the invention in which the rod glow plug has a body 7, preferably of metal, in which a heating rod 1 of a type known for rod glow plugs is located. The heating rod 1, has a shaped part 3 with an area 3*b* on the combustion space side which is conical for sealed interaction with the cylinder head hole of an internal combustion engine, the conical shape corresponding to the funnel-shaped execution of the cylinder head hole.

The terminal-side area of the shaped part 3 has an annular groove 3*a*. The plug body 7 has an annular edge, on its end 7*a* on the combustion space side, which is pressed into the groove 3*a* of the shaped part 3. Alternatively, this area of the plug body 7 can be extrusion coated as the shaped part 3 is formed. In this embodiment, the heating rod 1 is pressed into the body 7 with the shaped part 3. The terminal-side end area of the body 7 is supported on an insulating O-ring 5 which is located in a metal sleeve 4 around the elongated end area of the heating rod 1. Since there is no interlocking between the shaped part 3 with the heating rod 1 and the body 7, the body 7 can be twisted relative to the shaped part 3, and the annular edge 7*a* of the body 7 can turn in the annular groove 3*a* of the shaped part 3 when the latter sits securely in the cylinder head; this construction prevents concomitant turning of the heating rod 2 when the body 7 is screwed into the cylinder head.

Preferably, the area of the heating rod 1 on the combustion space side is surrounded, except for its tip 1*a*, with a ceramic jacket so that a defined and localized electrically conductive glow zone is formed on the heating rod tip 1*a*.

Figure 2:
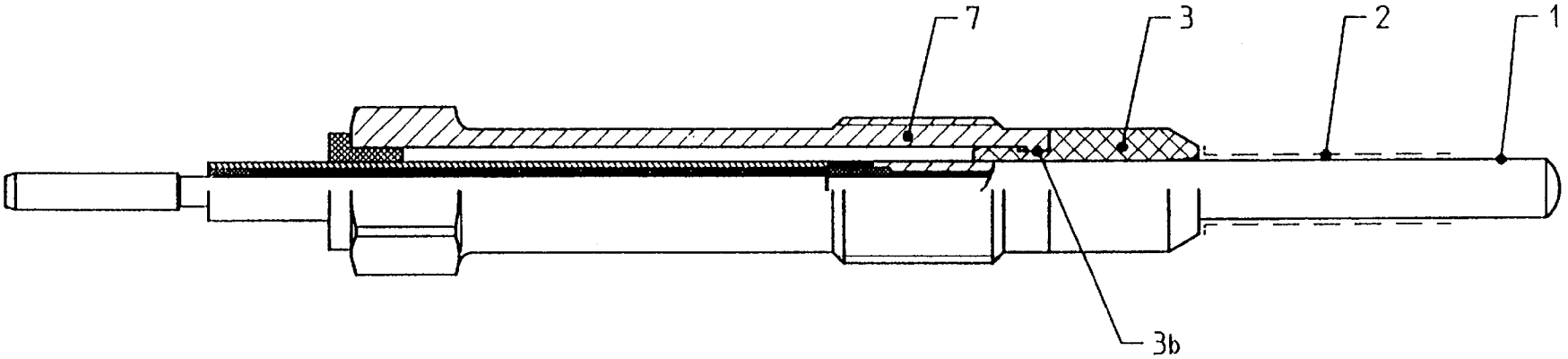
FIG. 2 is a partial lengthwise section of an embodiment in which the shaped part is pressed into the rod glow plug body.

In the embodiment as shown in FIG. 2, which otherwise corresponds to that of FIG. 1, the shaped part 3 is stepped in the body-side area 3*b*, the heating rod 1 being pressed into the shaped part 3; then the heating rod 1 is coated with an insulating layer 2 and then the heating rod 1 prepared in this way is joined with the shaped part 3 to the body 7.

Figure 3:
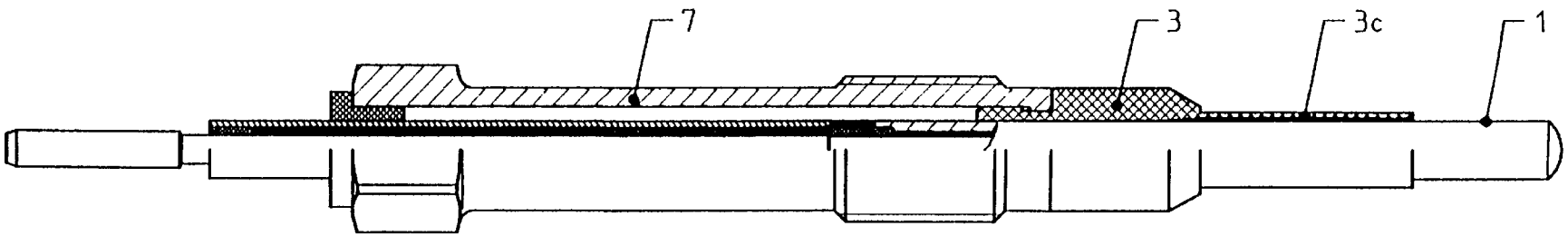
FIG. 3 is a partial lengthwise section of an embodiment in which the heating rod is pressed into the shaped part and the shaped part is pressed into the plug body.

In the embodiment as shown in FIG. 3, which otherwise corresponds to that in FIG. 2, first, the heating rod 1 is pressed into the shaped part 3 and then the shaped part 3 is pressed into the body 7. In this embodiment, the shaped part 3 has a cylindrical extension 3*c* on the combustion space side, preferably made of the same material as the shaped part 3. The extension 3*c* is used as insulation between the heating rod 1 and the cylinder head, the cylindrical extension 3*c* adjoining the cylinder head with a cylindrical air gap being formed by it relative to the heating rod 1.

Figure 4:
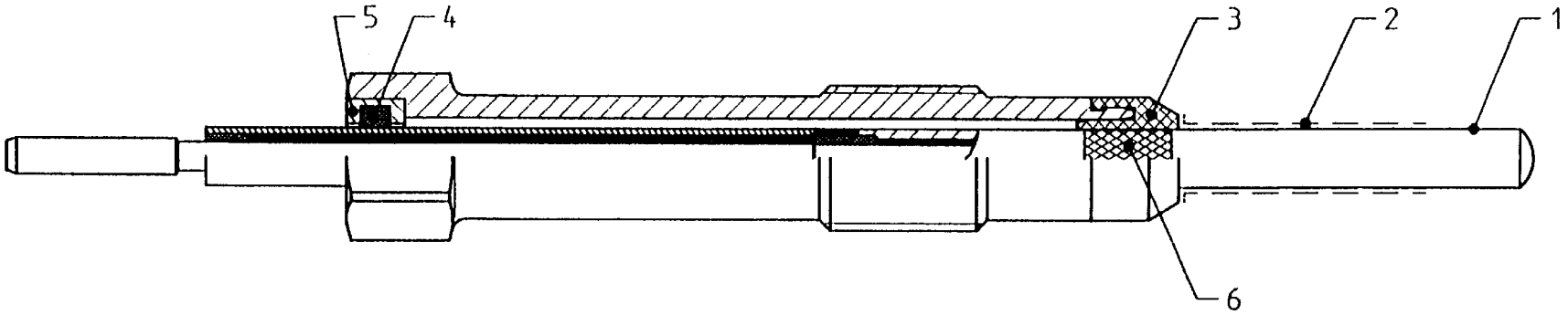
FIG. 4 is a partial lengthwise section of an embodiment in which the shaped part is injected into the heating rod and the plug body is inserted into the shaped part.

The embodiment as shown in FIG. 4 corresponds essentially to that as shown in FIG. 1, the seal seat area for shaped part 3 of the heating rod 1 being provided with a knurling 6; in this way, the form-fitted connection between the heating rod 1 and the insulating shaped part 3 or the injection mass of the shaped part 3 is improved. Here, the shaped part 3 is preferably injection molded onto the heating rod 1 in the area of the seal seat and then the body 7 is slipped on.

Figure 5:
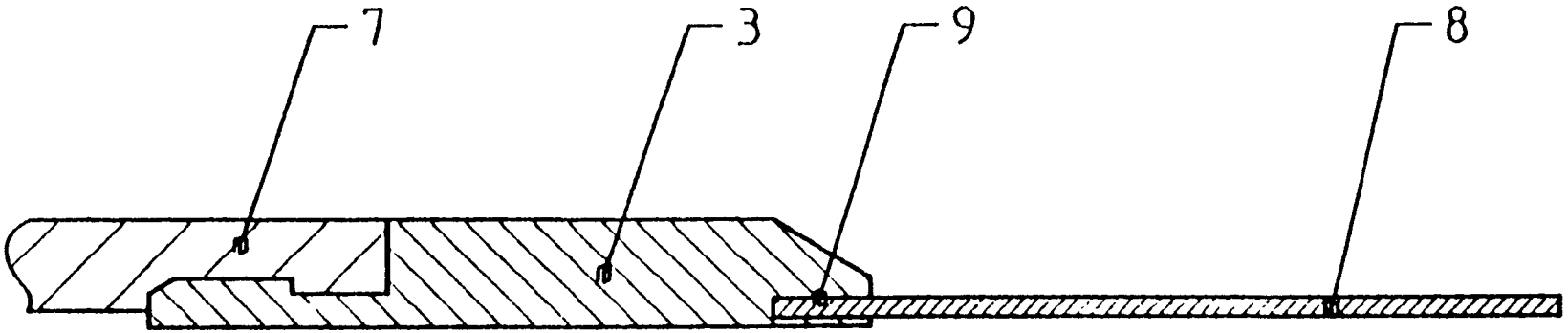
FIG. 5 is a partial lengthwise section of an extract from an embodiment with a temperature-resistant insulating tube inserted into the shaped part.

In the embodiment as shown in FIG. 5, the shaped part 3, on the body side, is made for locking connection with the body 7, and on the combustion space side, is constructed for holding a tube 8, preferably a temperature-resistant insulating tube. Here, in the area of the shaped part 3 on the combustion space side, there is a groove 9 which is annular and into which the tube 8 is pressed.

Figure 6:
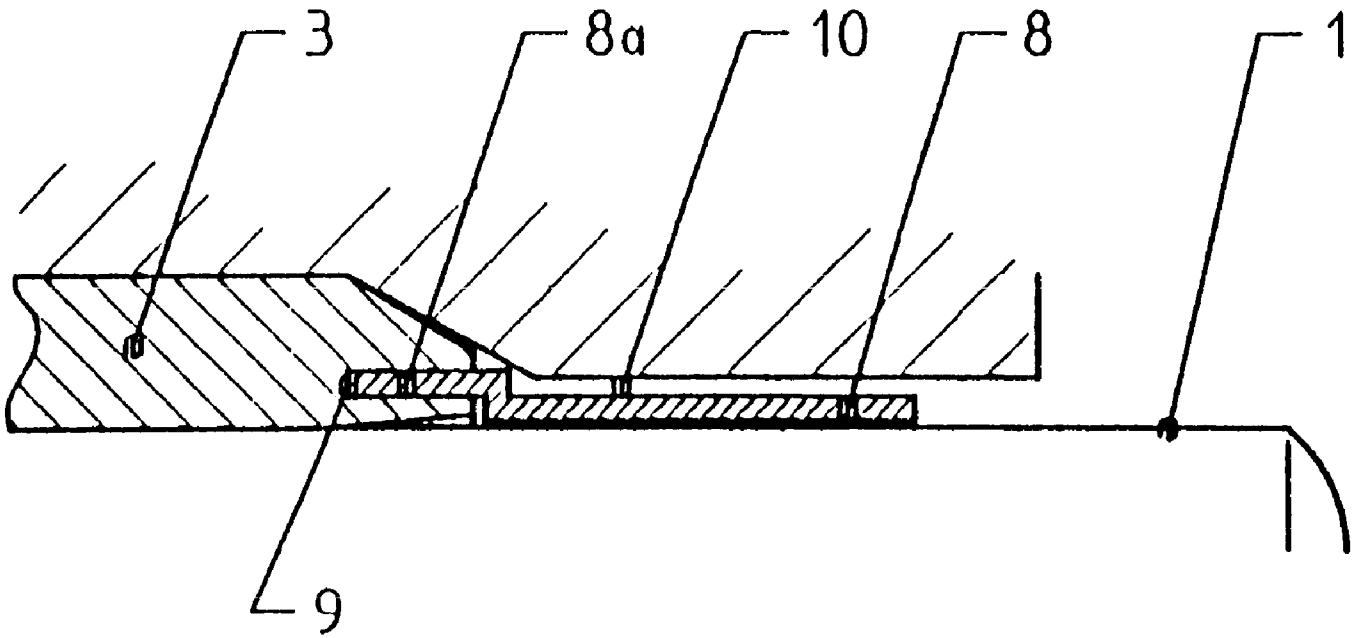
FIG. 6 is a partial lengthwise section of an extract similar to that according to FIG. 5 but with another temperature-resistant insulating tube.

The embodiment as shown in FIG. 6 corresponds essentially to that shown in FIG. 5 with the difference being that the tube 8, on end 8*a* closest to the shaped part, has a greater diameter than the remaining tube 8, the diameter of the tube 8 in the area 8*a* being somewhat larger than that of the cylinder head hole 10 into which the rod glow plug is inserted so that the tube 8 cannot fall into the hole if the area 8*a* of the tube 8 should detach from the groove 9 of the shaped part 3.

In all embodiments, the shaped part in accordance with the invention is made of plastic, ceramic, or any other temperature-resistant, electrically insulating material. It can be fabricated separately or made by injection onto the body 7 or the heating rod 1. The shaped part 3 which is made or located in the seal area of the rod glow plug can be adjusted to different sealing angles in different cylinder heads, for example, with an angle of 63°, 93° or 123°, and the body and the heating rod can remain unchanged.

What is claimed is:

1. Rod glow plug, comprising:

a plug body;

an internal heating rod; and an electrically insulating shaped part, wherein the electrically insulating shaped part is located between the heating rod and the plug body in a seal seat area of the rod glow plug; wherein the electrically insulating shaped part securely adjoins the heating rod, and wherein a combustion space-side end area of the plug body is supported by the electrically insulating shaped part with the plug body being electrically insulated from the heating rod by the electrically insulating shaped part.

2. Rod glow plug as claimed in claim 1, wherein the shaped part is sleeve-shaped, and wherein a combustion space-side end of the shaped part is conical for sealing interaction with a cylinder head hole of a given sealing angle of an internal combustion engine.

3. Rod glow plug as claimed in claim 1, wherein a body-side area of the shaped part is securely connected to an area of a shaped part side of the plug body.

4. Rod glow plug as claimed in claim 3, wherein the body-side area of the shaped part has an annular groove in which the area of the shaped part-side of the body is supported, the area of the shaped part-side of the body being in the form of an annular edge.

5. Rod glow plug as claimed in claim 1, wherein a part of the heating rod which emerges from the combustion space-side end of the shaped part is surrounded by a ceramic jacket, except for a tip portion of the heating rod.

6. Rod glow plug as claimed in claim 1, wherein a part of the heating rod which emerges from the combustion space-side end of the shaped part is surrounded by a temperature-resistant insulating tube, except for a tip portion of the heating rod.

7. Rod glow plug as claimed in claim 1, wherein a combustion space-side end of the shaped part is configured for supporting a tube, said tube surrounding a part of the heating rod which emerges from the combustion space-side end of the shaped part, except for a tip of the heating rod, with a clearance gap between the tube and the heating rod.

8. Rod glow plug as claimed in claim 7, wherein a shaped part-side edge area of the tube is fixed in an annular groove in the combustion space-side end of the shaped part.

9. Rod glow plug as claimed in claim 8, wherein the shaped part-side edge area of the tube has a larger diameter than a combustion space-side area of the tube, the diameter of the tube area of larger diameter being somewhat larger than that of a hole for the heating rod in a cylinder head of an internal combustion engine in which said glow plug is adapted to be mounted in use.

10. Rod glow plug as claimed in claim 1, wherein the shaped part has a cylindrical projection which extends in a direction toward a tip of the heater rod and which is made of the same insulating material as the shaped part, the cylindrical extension having a somewhat larger inner diameter than an outer diameter of the heating rod so as to form a cylindrical air gap between the cylindrical extension and the heating rod.

11. Rod glow plug as claimed in claim 2, wherein a body-side area of the shaped part is securely connected to an area of a shaped part side of the plug body.

12. Rod glow plug as claimed in claim 11, wherein the body-side area of the shaped part has an annular groove in which the area of the shaped part-side of the body is supported, the area of the shaped part-side of the body being in the form of an annular edge.

13. Rod glow plug as claimed in claim 2, wherein a part of the heating rod which emerges from the combustion space-side end of the shaped part is surrounded by a ceramic jacket, except for a tip portion of the heating rod.

14. Rod glow plug as claimed in claim 2, wherein a part of the heating rod which emerges from the combustion space-side end of the shaped part is surrounded by a temperature-resistant insulating tube, except for a tip portion of the heating rod.

15. Rod glow plug as claimed in claim 2, wherein a combustion space-side end of the shaped part is configured for supporting a tube, said tube surrounding a part of the heating rod which emerges from the combustion space-side end of the shaped part, except for a tip of the heating rod, with a clearance gap between the tube and the heating rod.

16. Rod glow plug as claimed in claim 15, wherein a shaped part-side edge area of the tube is fixed in an annular groove in the combustion space-side end of the shaped part.

17. Rod glow plug as claimed in claim 16, wherein the shaped part-side edge area of the tube has a larger diameter than a combustion space-side area of the tube, the diameter of the tube area of larger diameter being somewhat larger than that of a hole for the heating rod in a cylinder head of an internal combustion engine in which said glow plug is adapted to be mounted in use.

18. Rod glow plug as claimed in claim 2, wherein the shaped part has a cylindrical projection which extends in a direction toward a tip of the heater rod and which is made of the same insulating material as the shaped part, the cylindrical extension having a somewhat larger inner diameter than an outer diameter of the heating rod so as to form a cylindrical air gap between the cylindrical extension and the heating rod.

* * * * *